US007303466B2

(12) United States Patent
Boo et al.

(10) Patent No.: US 7,303,466 B2
(45) Date of Patent: Dec. 4, 2007

(54) CARRIER HEAD OF CHEMICAL MECHANICAL POLISHING APPARATUS HAVING BARRIERS DIVIDING PRESSURE CHAMBER INTO A PLURALITY OF PRESSURE ZONES

(75) Inventors: Jae-Phil Boo, Seongnam (KR); Jue-Young Lee, Suwon (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 458 days.

(21) Appl. No.: 10/959,113

(22) Filed: Oct. 7, 2004

(65) Prior Publication Data

US 2005/0272346 A1 Dec. 8, 2005

(51) Int. Cl.
*B24B 5/00* (2006.01)
*B24B 7/00* (2006.01)
*B24B 41/06* (2006.01)

(52) U.S. Cl. ..... 451/285; 451/288; 451/397; 451/402

(58) Field of Classification Search ..... 451/285, 451/287, 288, 289, 290, 397, 398, 402
See application file for complete search history.

(56) References Cited

U.S. PATENT DOCUMENTS 5,423,716 A * 6/1995 Strasbaugh ..... 451/388
5,916,016 A 6/1999 Bothra
5,964,653 A 10/1999 Perlov et al.
6,210,255 B1 * 4/2001 Zuniga et al. ..... 451/41
6,361,419 B1 * 3/2002 Zuniga et al. ..... 451/287
6,390,905 B1 5/2002 Korovin et al.
6,979,250 B2 * 12/2005 Zuniga et al. ..... 451/41
7,033,260 B2 * 4/2006 Togawa et al. ..... 451/388
7,101,271 B2 * 9/2006 Moon ..... 451/285
7,140,956 B1 * 11/2006 Korovin et al. ..... 451/289

FOREIGN PATENT DOCUMENTS

JP 11-226865 8/1999
KR 10-2002-7012953 3/2003

* cited by examiner

*Primary Examiner*—Timothy V. Eley
(74) *Attorney, Agent, or Firm*—Volentine & Whitt, PLLC

(57) ABSTRACT

A carrier head of a chemical mechanical polishing apparatus has a support, an elastic membrane secured to the support and spaced from the bottom surface of the support so that a pressure chamber is defined between the membrane and the bottom surface of the support; and at least one annular barrier of elastic material extending from the bottom surface of the support. Each barrier has an annular partition portion that extends through the pressure chamber and divides the pressure chamber into respective pressure zones on opposite sides thereof, and an annular contact portion that abuts the membrane such that the barrier contacts the membrane but is not fixedly attached thereto. The contact portion includes a pair of annular flanges extending laterally in opposite directions at the lower end of the partition portion.

27 Claims, 9 Drawing Sheets

CARRIER HEAD OF CHEMICAL MECHANICAL POLISHING APPARATUS HAVING BARRIERS DIVIDING PRESSURE CHAMBER INTO A PLURALITY OF PRESSURE ZONES

BACKGROUND OF THE INVENTION

1. Field of the Invention

The present invention relates to chemical mechanical polishing (CMP) apparatus for polishing a substrate such as a semiconductor wafer. More particularly, the present invention relates to the carrier head of a CMP apparatus that holds the substrate against a polishing pad of the apparatus.

2. Description of the Related Art

Integrated circuits are typically fabricated on a silicon wafer. To this end, conductive, semi-conductive and/or insulating layers are sequentially formed on the wafer. After one or more of the layers are formed, the layer(s) is/are etched to create circuitry features. The surface of the wafer thus becomes increasingly non-planar as the layers are sequentially formed and etched. This non-planar surface presents problems in subsequent processes used to fabricate the integrated circuit, such as in a photolithography process. Therefore, there is a need to periodically planarize the surface of the wafer.

Chemical mechanical polishing (CMP) is a process typically used for this purpose. The CMP process is well-suited for planarizing wafers of various sizes, i.e., even large-diameter wafers, because the CMP process produces excellent uniformity in planarizing relatively wide areas.

The CMP process makes use of mechanical friction and a chemical agent for finely polishing the surface of a wafer. In the mechanical aspect of such polishing, a wafer is placed on a rotating polishing pad while a predetermined load is applied thereto, whereby the wafer surface is polished by the friction created between the polishing pad and the wafer surface. In the chemical aspect of such polishing, the wafer surface is polished by a chemical polishing agent provided in a slurry that is introduced between the polishing pad and the wafer. The slurry may also contain abrasive particles that assist in the mechanical polishing of the wafer surface.

Typical CMP apparatus are disclosed in U.S. Pat. Nos. 5,423,716, 6,210,255, and 6,361,419. In these CMP apparatus, a wafer is held by a carrier head. Then the surface of the wafer to be polished (the process surface or polishing surface) is placed against the polishing pad by the carrier head. At this time, the carrier head exerts a controllable pressure at the rear surface of the wafer.

More specifically, the carrier head includes a flexible membrane that provides a mounting surface to which the wafer is adhered, and a retaining ring to prevent the wafer from leaving the carrier head. The carrier head also includes a pressure chamber, and air inlets leading into the chamber. The membrane is expanded by feeding air into the chamber via the inlets. Thus, the load on the wafer is controlled by the amount of air fed into the pressure chamber of the carrier head.

Frequently, however, it is necessary to exert pressure on the wafer that varies from region to region across the wafer. To this end, the pressure chamber in the carrier head may comprise a plurality of discrete pressure zones.

For example, U.S. Pat. Nos. 5,964,653 and 5,916,016 each disclose a carrier head comprising a membrane having a plurality of annular flaps that divide the pressure chamber into a plurality of pressure zones. The upper portions of the flaps are fixed to a membrane support and the bottom portion of the membrane is divided by the flaps into sections that correspond to various regions of the wafer. The sections of the membrane in each of the pressure zones are expanded when air is supplied into the pressure zones. However, each section of the membrane corresponding to a border between adjacent regions of the wafer, i.e., each section of the membrane constituted by a flap, is not expanded. Accordingly, the lower surface of this section of the membrane forms a concavity that prevents the CMP process from polishing the wafer with a high degree of uniformity.

U.S. Pat. No. 6,390,905 discloses a carrier head comprising a plurality of annular ribs whose feet abut the wafer to form a plurality of discrete plenums corresponding to various regions of the wafer. A first set of air supply lines communicate with the plenums so that the pressure exerted on the various regions of the wafer can be controlled. Alternatively, the ribs may be attached to or in contact with a membrane to which the wafer is adhered.

However, in the carrier head disclosed in U.S. Pat. No. 6,390,905, a good seal must be established between the feet of the ribs and the wafer or the membrane. To this end, a secondary set of air supply lines leads to the heads of the ribs. The air fed through these air lines assists in the pressing of the feet of the ribs against the wafer or the membrane. In one embodiment, the foot of the rib has a rounded cross section similar to that of a toroid or an 'elephant's' foot. The patent discloses that the air pressure in the plenums also acts on the 'elephant's' foot to assist the air fed through the secondary set of air supply lines in creating a seal. Even this may be insufficient, in which case a vacuum line is provided through the rib.

SUMMARY OF THE INVENTION

An object of the present invention is to provide a CMP apparatus comprising a carrier head having a plurality of pressure zones by which the pressure exerted on a wafer can be controlled over various regions of the wafer and wherein the pressure gradient across the pressure zones is especially smooth at the boundary between adjacent ones of the zones.

Similarly, another object of the present invention is to provide a barrier for use in dividing the pressure chamber of a CMP apparatus into adjacent pressure zones and which barrier is particularly useful in helping to facilitate a smooth transition in the pressure gradient across the pressure zones.

Another object of the present invention is to provide a CMP apparatus comprising a carrier head having a plurality of pressure zones by which the pressure exerted on a wafer can be controlled over various regions of the wafer and wherein a superior seal is maintained between adjacent ones of the pressure zones.

A carrier head according to the present invention comprises a support having a bottom surface, an elastic membrane secured to said support and spaced from the bottom surface of the support so that a pressure chamber is defined between the membrane and the bottom surface of the support, and at least one annular barrier of elastic material extending from the bottom surface of the support. Each barrier has an annular partition portion that extends through the pressure chamber and divides the pressure chamber into respective primary pressure zones on opposite sides thereof, and an annular contact portion that extends from a lower end of the partition portion. The contact portion has a bottom surface that abuts the membrane such that the barrier contacts the membrane but is not fixedly attached thereto.

According to one aspect of the invention, the contact portion comprises a pair of annular flanges extending laterally in opposite directions at the lower end of the partition portion. Each of the flanges has a cross section that has curvature and tapers to a point in a direction away from the partition portion. Therefore, fluid pressure in the pressure zones can deflect the flanges and the entire bottom surface of the contact portion can be maintained in contact with the membrane.

According to another aspect of the invention, the annular partition portion of the barrier comprises first and second annular walls spaced from one another in a radial direction of the barrier. A first primary pressure region is defined to one side of the barrier adjacent the first annular wall, and a second primary pressure region is defined to the other side of the barrier adjacent the second annular wall.

The annular contact portion of the barrier has a central section that extends between and connects lower ends of the first and second walls. Accordingly, a channel that forms at least part of a secondary pressure zone is defined between the annular walls of the partition portion, and by the central section of the partition portion. The partition portion also comprises a first annular flange that extends laterally from a lower end of the first annular wall in a direction away from the channel, and a second annular flange that extends laterally from a lower end of the second annular wall in a direction away from the channel. Fluid introduced into the channel exerts a precisely controllable pressure on the membrane via primarily the central section of the contact portion, whereby the pressure gradient across the pressure zones may be smooth. Moreover, the contact portion has a relatively large bottom surface that can be pressed into surface-to-surface contact with the membrane, thereby offering a superior ability to create a seal with the membrane.

According to still another aspect of the present invention, at least one annular barrier extends from the bottom surface of the support, with the annular partition portion of each barrier comprising first and second annular walls spaced from one another in a radial direction of the barrier. Each barrier defines a channel between the annular walls, the channel constituting an annular secondary pressure zone in the pressure chamber of the carrier head. This secondary pressure zone is narrower than each of the primary pressure zones adjacent the opposite sides of the barrier as measured in the radial direction of the barrier. The annular contact portion of each barrier comprises a first annular flange that extends from a lower end of the first annular wall into one of the primary pressure zones, and a second annular flange that extends from a lower end of the second annular wall into the other primary pressure zone.

In addition, a first fluid pressure supply line system comprises first fluid supply lines extending through the support. The first fluid supply lines respectively communicate with the primary pressure zones so as that fluid can be fed into the zones. A secondary fluid pressure supply line system, discrete from the first fluid pressure supply line system, comprises at least one second fluid pressure supply line extending through the support. The secondary fluid supply line(s) communicates with the secondary pressure region(s).

Fluid introduced into the channel(s) through the secondary fluid pressure supply line system exerts a precisely controllable pressure on the membrane, whereby the pressure gradient across the primary pressure zones may be smooth.

According to any aspect of the present invention described above, the bottom surface of the contact portion is preferably concave when the barrier is in its relaxed state. Alternatively, though, the bottom surface of the contact portion may be flat or convex when the barrier is in its relaxed state.

BRIEF DESCRIPTION OF THE DRAWINGS

These and other objects, features and advantages of the present invention will become better understood from the following detailed description of the preferred embodiments thereof made with reference to the attached drawings, of which.

DETAILED DESCRIPTION OF THE PREFERRED EMBODIMENTS

Figure 1:
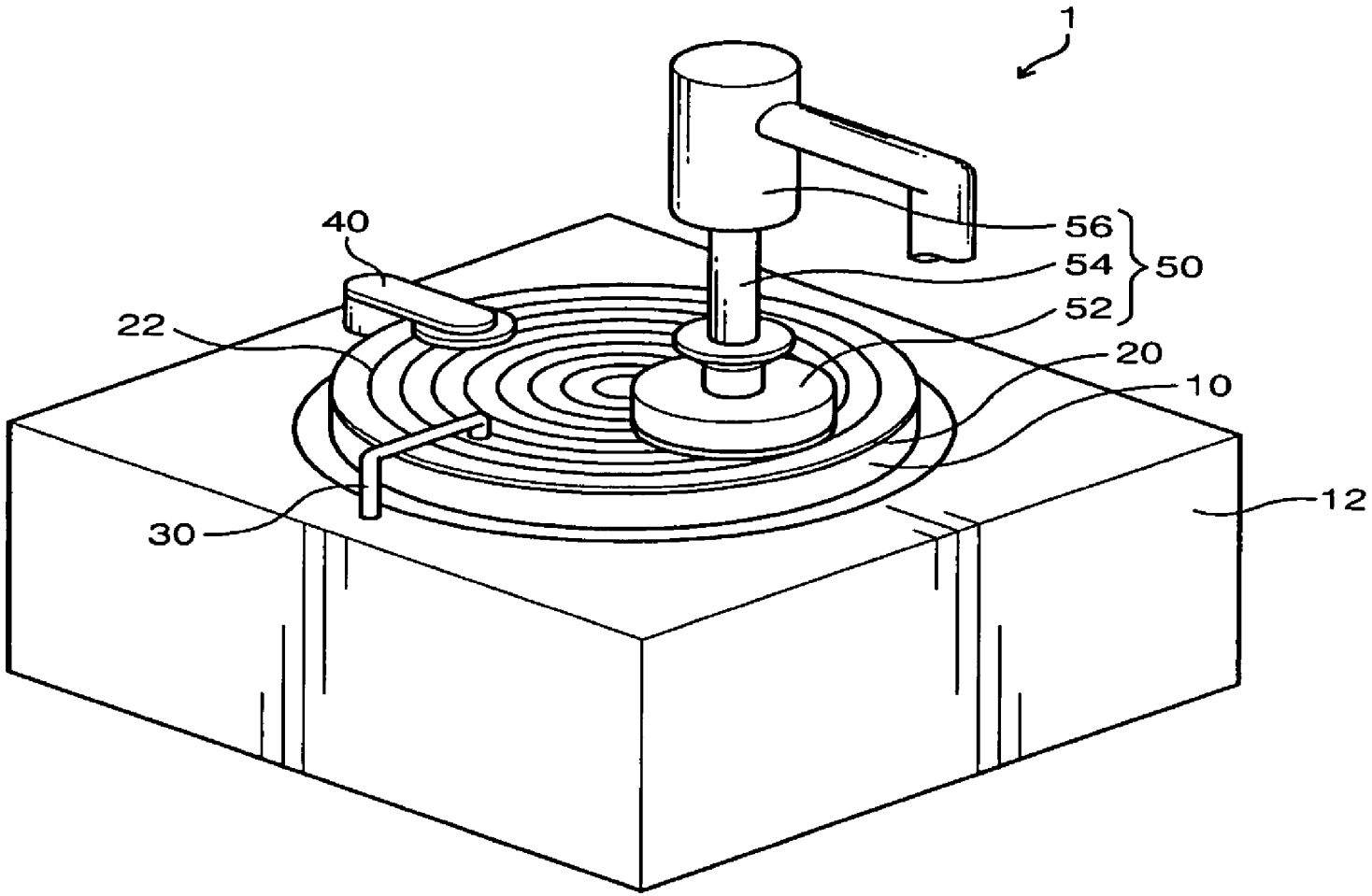
FIG. 1 is a perspective view of the general structure of a chemical mechanical polishing (CMP) apparatus according to the present invention.
Figure 2:
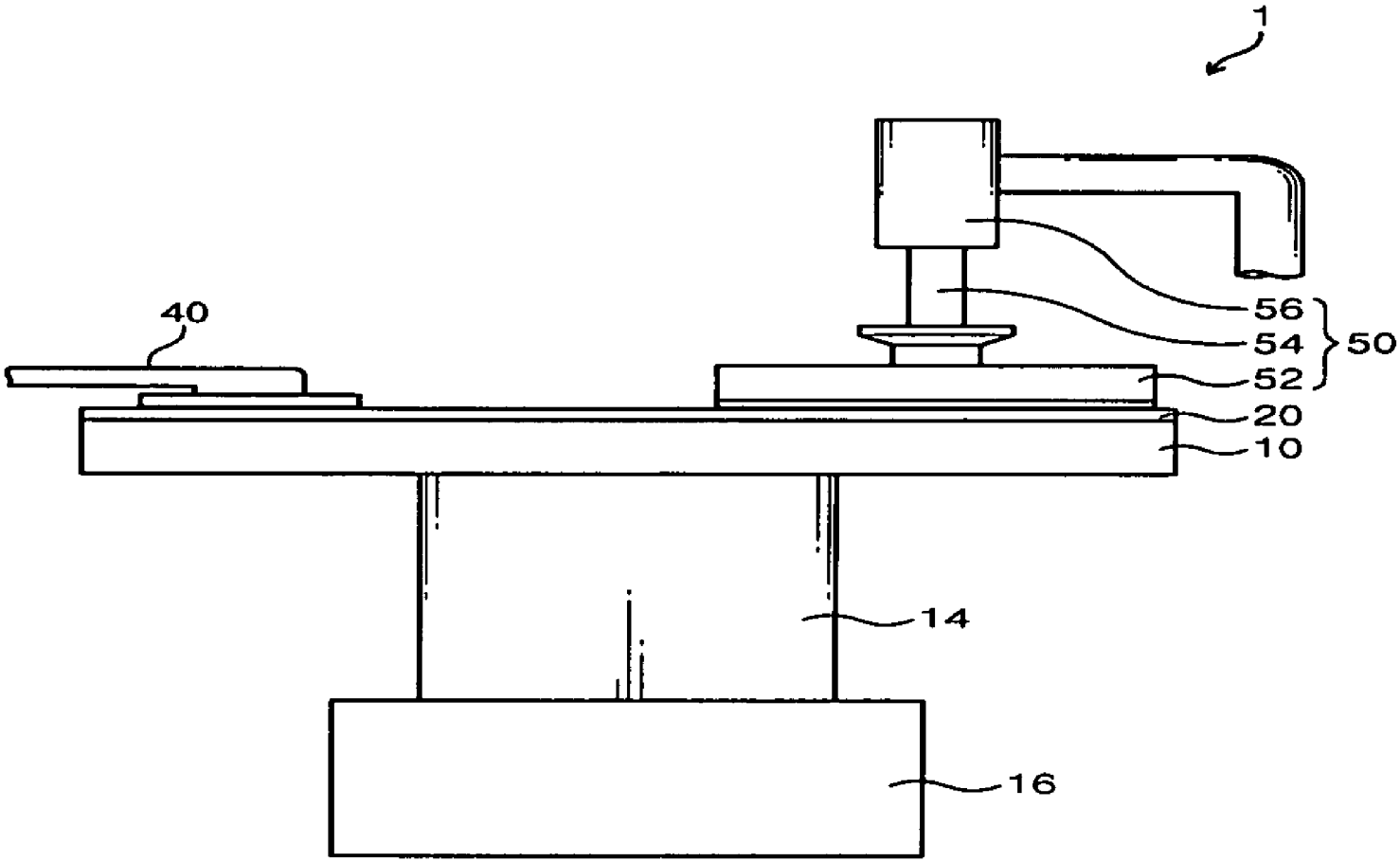
FIG. 2 is a side view of the chemical mechanical polishing (CMP) apparatus.

First, the general structure of a chemical mechanical polishing (CMP) apparatus will be described with reference to FIGS. 1 and 2.

The CMP apparatus 1 comprises a platen 10, a platen drive shaft 14, a platen drive motor 16, and a base 12 in which the platen drive shaft 14 and platen drive motor 16 are disposed. The platen 10 is supported by the platen drive shaft 14 as exposed at the upper surface of the base 12. A polishing pad 20 is adhered to the upper surface of the platen 10. The platen drive motor 16 rotates the platen drive shaft 14 and hence, the platen 10 and polishing pad 20.

The CMP apparatus 1 also comprises a slurry supply arm 30, a pad conditioner 40, and a carrier assembly 50. The slurry supply arm 30 is used to supply slurry onto the upper surface of the polishing pad 20. The pad conditioner 40 comprises an abrasive disk or the like that is pressed against the surface of the polishing pad 20 to scour the pad 20 and thereby maintain the condition of the upper surface of the pad. The carrier assembly 50 is, in general, situated above the base 16 over the platen 10 and polishing pad 20.

The carrier assembly 50 includes a carrier head 52, a drive shaft 54 that supports the carrier head 52, and a motor 56 connected to the drive shaft 54. The carrier head 52 secures a wafer with a front surface of the wafer exposed, and is driven through the drive shaft 54 so that the front surface of the wafer is urged against the polishing pad 20.

During the polishing process, the polishing pad 20 is rotated, slurry is supplied onto the upper surface of the polishing pad 20 through the slurry supply arm, and the carrier head 52 retains the wafer in a polishing position at which a wafer is held approximately parallel to the abrasive surface atop the polishing pad 20. Most notably, though, the carrier head 52 exerts a controlled pressure on the back of the wafer during the polishing process. The carrier head 52 may also be rotated in a direction opposite to the direction of rotation of the platen 10 and/or otherwise moved across the upper surface of the polishing pad 20. Thus, the slurry flows between the upper surface of the polishing pad and the front surface of the wafer. Accordingly, the front surface of the wafer is polished mechanically by friction and chemically by the chemical agent constituting the slurry.

Figure 3:
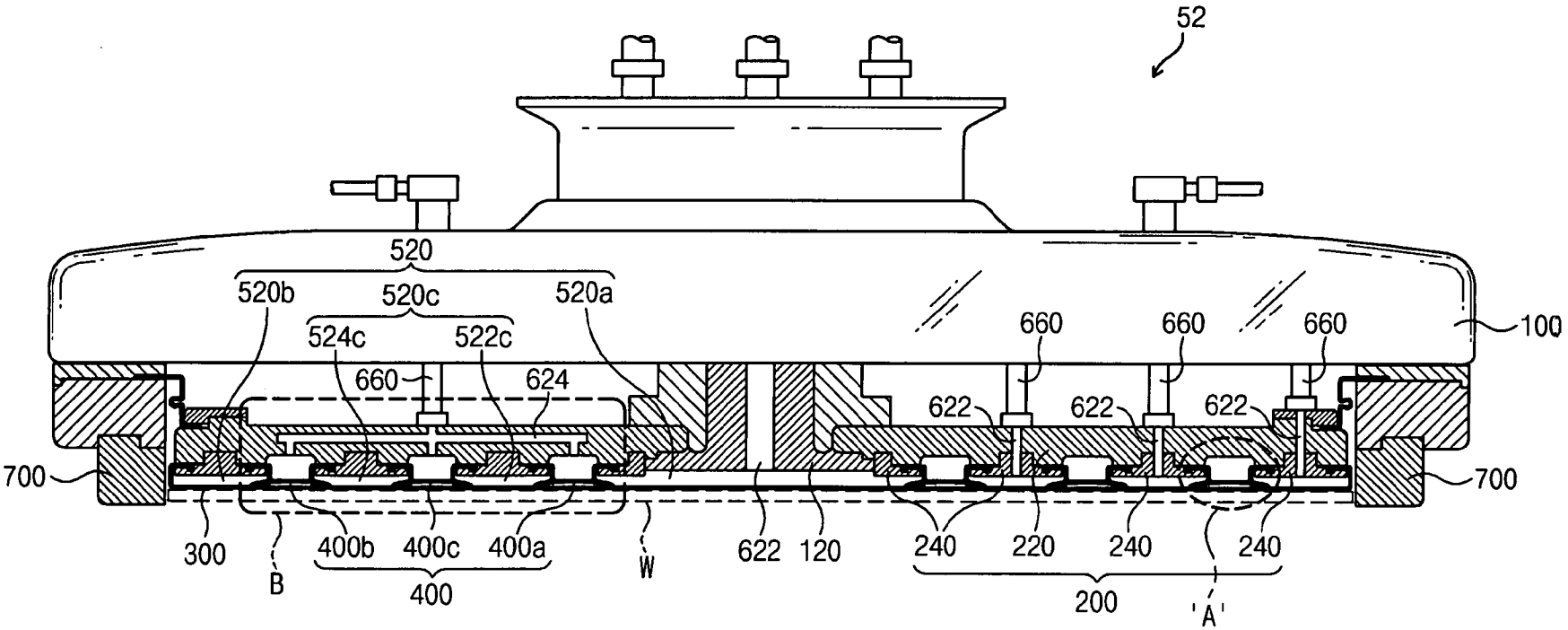
FIG. 3 is a side view, partially in section, of a carrier head of a CMP apparatus according to the present invention.

The carrier head 52 of the CMP apparatus according to the present invention will now be described in more detail with reference to FIG. 3. The carrier head 52 includes a rigid cylindrical carrier base 100 that provides a superstructure, a support 200 secured to the carrier base over the lower major surface of the base 100, an elastic membrane 300 secured to the support 200 and spaced from the bottom surface of the support 200 so that a pressure chamber 520 is defined therebetween, a plurality of concentric annular barriers 400 that divide the pressure chamber 520 into respective primary pressure zones 520*a*, 520*b*, and 520*c*, fluid supply line systems 660 through which air is introduced into the pressure zones, and a retainer ring 700 that surrounds the wafer W during the polishing process to keep the wafer W from escaping laterally from beneath the carrier head.

The upper major surface of the base 100 is adapted to be connected to one or more drive shafts of the carrier assembly, e.g., the drive shaft 54. The drive shaft(s) transport the carrier head 52 from a loading station, at which a wafer is secured to the carrier head 52, to the polishing position shown in FIGS. 1 and 2, and from the polishing position to an unloading station at which a polished wafer is removed from the carrier head 52. The drive shaft(s) may also impart rotary motion or the like to the carrier head 52 during the polishing process.

The support 200 has a top portion 220 in the form of a circular plate, and a bottom portion 240 comprising a plurality of annular plates secured to the circular plate of the top portion 220. The membrane 300 is clamped between the top portion 220 and the outermost annular plate of the bottom portion 240 of the support 200. Each barrier 400 is clamped between the top portion 220 and adjacent ones of the annular plates of the bottom portion 240 of the support.

Each barrier 400 is preferably made of an elastic material such as rubber or a synthetic resin. The barriers 400 extend downwardly from the support 200 into contact with the membrane 300, thereby dividing the pressure chamber 520 into a plurality of discrete pressure zones on opposite sides of the barriers. For example, first, second and third barriers 400*a*, 400*b* and 400*c* divide the pressure chamber 520 into a central circular pressure zone 520*a*, an outermost annular pressure zone 520*b*, and intermediate annular pressure zones 522*c*, 524*c*.

Figure 4:
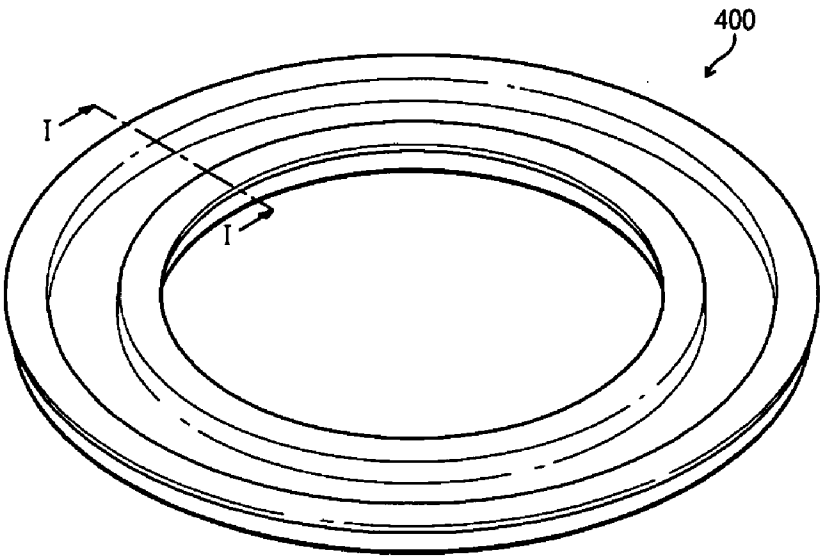
FIG. 4 is a perspective view of an embodiment of a barrier used in a carrier head according to the present invention.

A first embodiment of a barrier 400 will now be described in more detail with reference to FIGS. 4 and 5. The barrier 400 has an annular fixing portion 420, an annular partition portion 440, and an annular contact portion 460. The fixing portion extends from the upper end of the partition portion 440, whereas the contact portion 460 extends from the lower end of the partition portion 420.

More specifically, the partition portion 440 comprises first and second annular walls spaced from one another in a radial direction of the barrier.

The contact portion 460 comprises a central section 482 that extends between and connects lower ends of the first and second walls of the partition portion 440 such that an annular channel 480 is formed by the partition portion 440 and the central section 482 of the contact portion. The contact portion 460 also comprises a first annular flange that extends laterally from a lower end of the first annular wall of the partition portion 440 in a direction away from the central section 482, and a second annular flange that extends laterally from a lower end of the second annular wall of the partition portion 440 in a direction away from the central section 482. Overall, the contact portion 460 has a crescent-shaped cross section as best shown in FIG. 5 wherein the bottom surface thereof is concave and the upper surface is convex.

The fixing portion 420 comprises a first annular section extending laterally from the upper end of the first annular wall of the partition portion 440, and a second annular section extending laterally from the upper end of the second annular wall of the partition portion 440.

Figure 6:
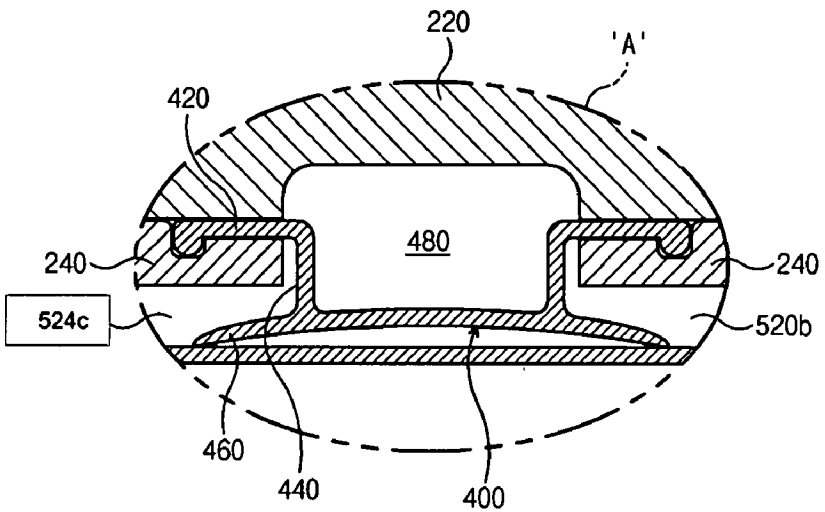
FIG. 6 is an enlarged sectional view of portion 'A' of the carrier head shown in FIG. 3.

Referring now to FIG. 6, each of the annular sections of the fixing portion 420 of the barrier 400 is clamped between the upper portion 220 of the support and a respective one of the annular plates of the bottom portion 240 of the support. The contact portion 460 of the barrier 400 is urged downwardly against the membrane 300 by pressure created in the channel 480. Pressure in the adjacent pressure zones 520*b*, 524*c* acts directly on the membrane 300 to expand the membrane and thereby, in turn, exert pressure on various regions of the wafer corresponding to the pressure zones 520*b*, 524*c*.

The width of the channel 480 is substantially less than that of each of the adjacent pressure zones 520*b*, 524*c*, and is preferably less than 20 mm, as taken in the radial direction of the barrier. According to the present invention, the pressure in the channel 480 can be regulated with a high degree of accuracy to thereby produce pressure on the membrane 300 at the boundary between pressure zones 520*b*, 524*c*. Therefore, the pressure gradient across the pressure zones 520*b*, 524*c* is especially smooth. That is, a spike in the pressure distribution is avoided and hence, the uniformity in the polishing process is enhanced.

Figure 7:
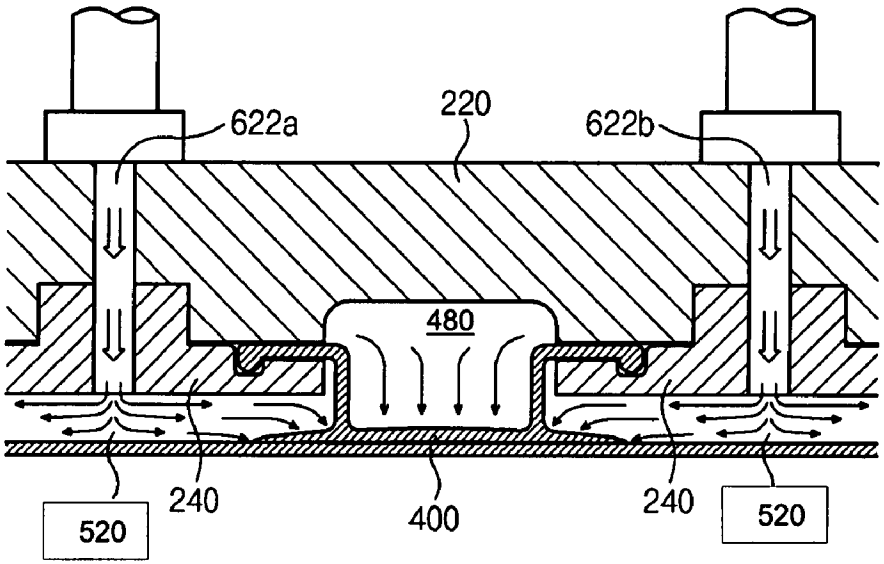
FIG. 7 is an enlarged sectional view of a portion of the carrier head comprising a barrier, the adjacent pressure zones on opposite sides of the barrier, and a secondary pressure region defined between annular walls of the barrier.

FIG. 7 illustrates the superior seal established between a barrier 400 and the membrane 300 when fluid is introduced into a secondary pressure zone comprising the channel 480 and the primary pressure zones 520 on opposite sides of the barrier 400. A primary fluid supply line system comprises fluid supply lines 622*a*, 622*b* that extend through the top and bottom portions 220, 240 of the support to the primary pressure zones 520. As shown by the arrows, the fluid flowing through the lines 622*a*, 622*b* not only expands the membrane 300 but also acts against the annular flanges of the contact portion 460 of the barrier to deflect the flanges into surface-to-surface contact with the membrane 300. Likewise, air introduced through a fluid supply line leading to the secondary pressure zone, i.e., into the channel 480, urges the central section of the contact portion 460 into surface-to-surface contact with the membrane 300.

Figure 8:
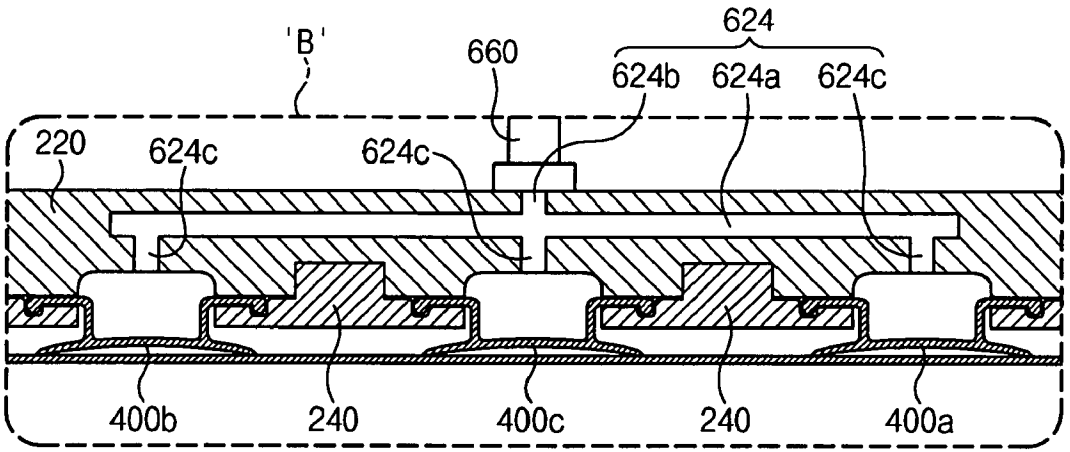
FIG. 8 is an enlarged sectional view of portion 'B' of the carrier head shown in FIG. 3.
Figure 9:
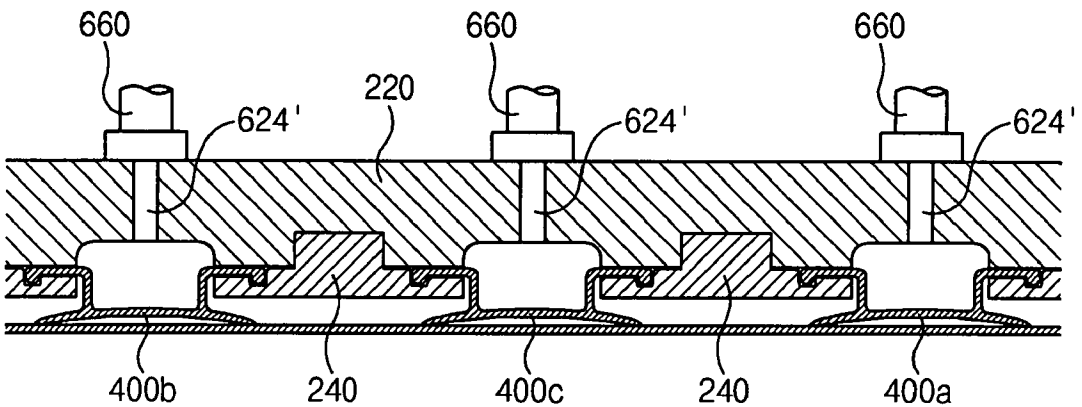
FIG. 9 is a view similar to that of FIG. 8, but showing another form of the secondary fluid pressure line system by which the pressure in the respective pressure regions defined by the barriers can be independently controlled.

FIGS. 8 and 9 show secondary fluid supply systems that can be used to introduce fluid into the secondary pressure zones. In the system 660 shown in FIG. 8, the fluid supply line 624 includes an inlet port 624*b*, a common delivery passageway 624*a* connected to the inlet port 624*b*, and a plurality of outlet ports each placing the common delivery passageway 624*a* in communication with a respective one of the secondary pressure zones. Accordingly, the same pressure prevails in each of the secondary pressure zones. On the other hand, in the system 660 shown in FIG. 9, the fluid supply lines 624' are discrete from one another. Individually controllable pumps or fluid pressure regulators can be respectively connected to the lines 624' so that the pressure in each of the secondary pressure zones can be independently controlled. In this way, the pressure in each of the secondary pressure zones can be set according to the pressure in the primary pressure zones 520 to produce the smoothest possible pressure distribution across the regions of the wafer.

Figure 11:
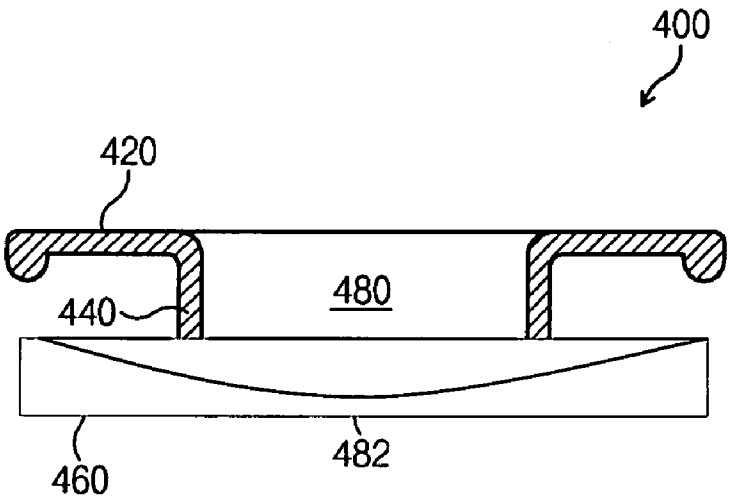
FIG. 11 is a sectional view of still another form of a barrier according to the present invention.
Figure 10:
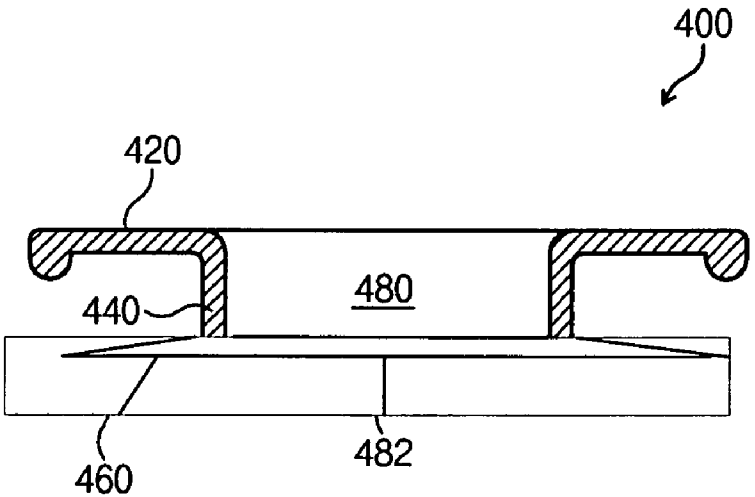
FIG. 10 is a sectional view of another form of a barrier according to the present invention.

FIGS. 10 and 11 respectively show other forms of the barrier 400 that can be used in a carrier head according to the present invention. In the barrier 400 shown in FIG. 10, the bottom surface of the contact portion 460 is flat when the barrier is in its relaxed state. On the other hand, in the barrier 400 shown in FIG. 11, the bottom surface of the contact portion 460 is convex when the barrier is in its relaxed state.

Nonetheless, in each of the barriers according to the present invention, the annular flanges of the contact portion 460 each have a cross section that has curvature and tapers to a point in a direction away from the partition portion. Accordingly, fluid pressure in the primary pressure zones can easily deflect the flanges and readily keep the flanges pinned to the membrane 300. Thus, the entire bottom surface of the contact portion 460 can be kept in contact with the membrane 300, whereby a superior seal is established between the barrier 400 and the membrane 300.

Figure 12:
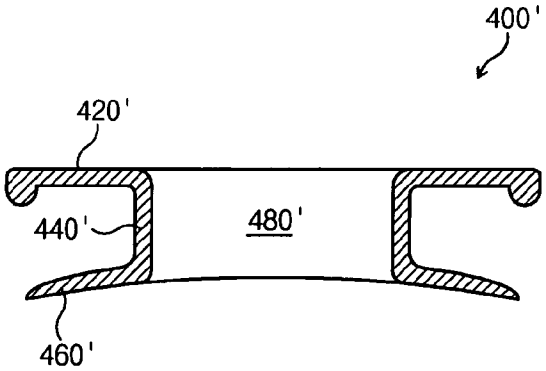
FIG. 12 is a sectional view of another embodiment of a barrier used in a carrier head according to the present invention.
Figure 14:
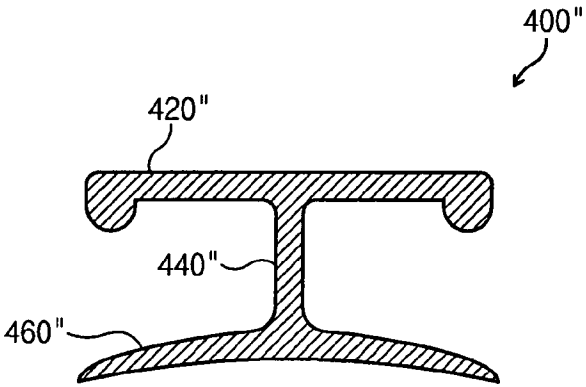
FIG. 14 is a cross-sectional view of the barrier shown in FIG. 13 as taken along lines II-II of FIG. 13.
Figure 13:
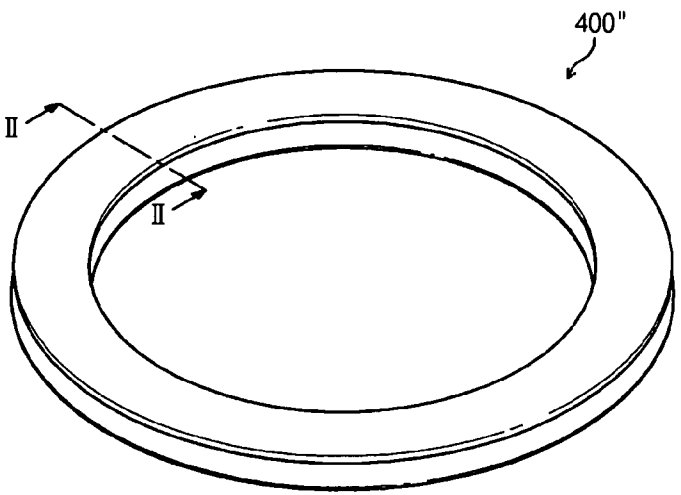
FIG. 13 is a perspective view of another embodiment of a barrier used in a carrier head according to the present invention.

FIGS. 12-14 show other embodiments of a barrier possessing similarly advantageous features.

In the embodiment of FIG. 12, the barrier 400' has an annular fixing portion 420', an annular partition portion 440', and an annular contact portion 460'. Like the embodiment of FIGS. 4 and 5, the fixing portion 420' extends from the upper end of the partition portion 440', whereas the contact portion 460' extends from the lower end of the partition portion 420'. Also, the partition portion 440' comprises first and second annular walls spaced from one another in a radial direction of the barrier so as to define a channel 480' therebetween. The fixing portion 420' comprises a first annular section extending laterally from the upper end of the first annular wall of the partition portion 440', and a second annular section extending laterally from the upper end of the second annular wall of the partition portion 440'.

However, in this embodiment, the contact portion 460' consists of a first annular flange that extends laterally outwardly (in a radially outward direction) from a lower end of the first annular wall of the partition portion 440', and a second annular flange that extends laterally outwardly (in a radially inward direction) from a lower end of the second annular wall of the partition portion 440. Accordingly, pressure created in the channel 480' acts directly on the portion of the membrane 300 located at the bottom of the channel. In this case, therefore, the barrier 400' comprises first and second annular discrete members spaced apart from one another. Each of the discrete members is constituted by a respective annular wall of the partition portion 440', and the flange of the fixing portion 460' and annular section of the contact portion 420' extending therefrom.

Also, as in the previous embodiment, each of the flanges of the contact portion 460' has a cross section that has curvature and tapers to a point in a direction away from the partition portion, with the bottom surface thereof being concave, as shown in the figure. Alternatively, the bottom surface may be flat or convex as shown per FIGS. 10 and 11.

In the embodiment of FIGS. 13 and 14, the barrier 400" has an annular fixing portion 420", an annular partition portion 440", and an annular contact portion 460". The fixing portion 420" extends from the upper end of the partition portion 440", whereas the contact portion 460" extends from the lower end of the partition portion 420'". However, unlike the previously described embodiments, the partition portion 440" consists of a single annular wall. Thus, the secondary pressure zone is provided atop the barrier 400" in support 200. Pressure created in the secondary pressure zone acts on the contact portion 460" through the central section of the fixing portion 420" and wall of the partition portion 440".

Also, the contact portion 460" comprises first and second annular flanges extending laterally in opposite directions from the lower end of the partition portion 440". Each of the flanges has a cross section that has curvature and tapers to a point in a direction away from the partition portion, with the bottom surface thereof being concave, as shown in the figure. Alternatively, the bottom surface may be flat or convex as shown per FIGS. 10 and 11.

Figure 5:
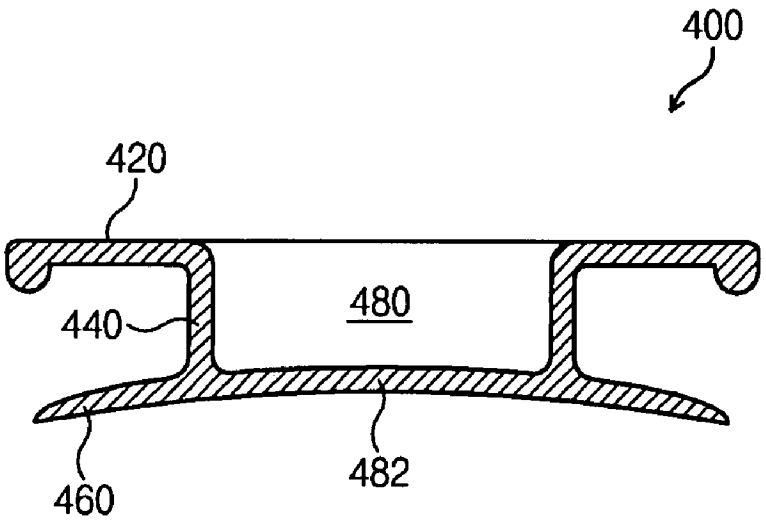
FIG. 5 is a cross-sectional view of the barrier as taken along lines I-I of FIG. 4.
Figure 15:
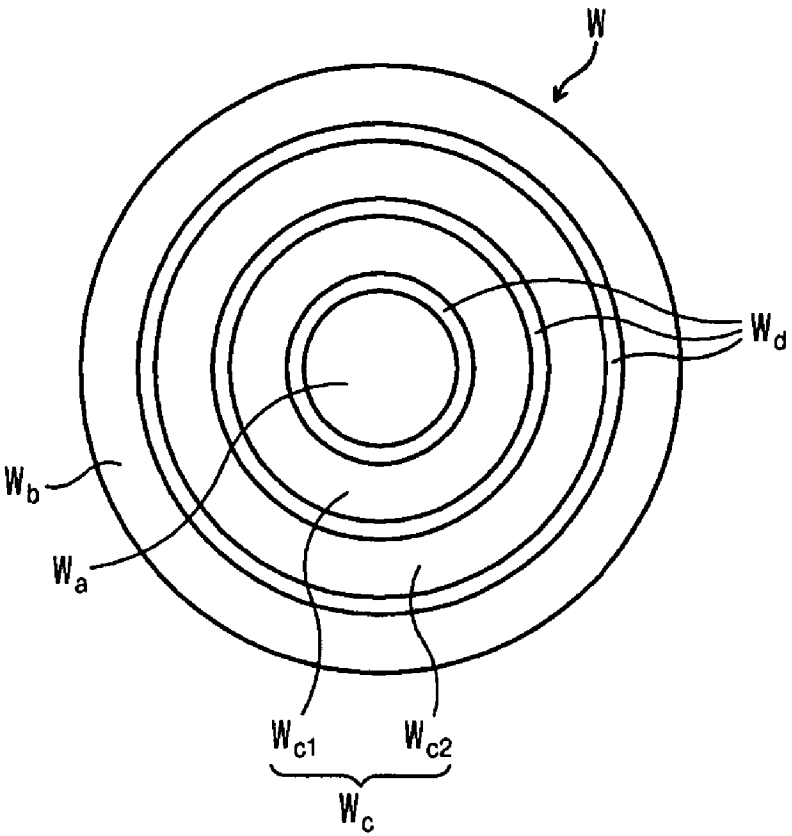
FIG. 15 is a conceptual plan view of the regions of pressure created on a wafer when barriers of the types shown in FIGS. 5 or 12 are used in a carrier head according to the present invention.

FIG. 15 illustrates the regions of pressure created on the wafer W, corresponding to the primary 520 and secondary 480 pressure zones, when barriers of the types shown in FIG. 5 or 12 are used. In the figure, $W_a$ designates a central circular region of pressure corresponding to primary pressure zone 520*a* (refer back to FIG. 3), $W_c$ designates one or more annular intermediate pressure regions corresponding to primary pressure zone(s) 520*c* ($W_{c1}$, $W_{c2}$ corresponding to 522*c*, 524*c*), and $W_b$ designates an outer annular region of pressure corresponding to the primary pressure zone 520*b*. $W_d$, on the other hand, represents regions of pressure corresponding to the secondary pressure zones constituted by channels 480 or 480'.

Figure 16:
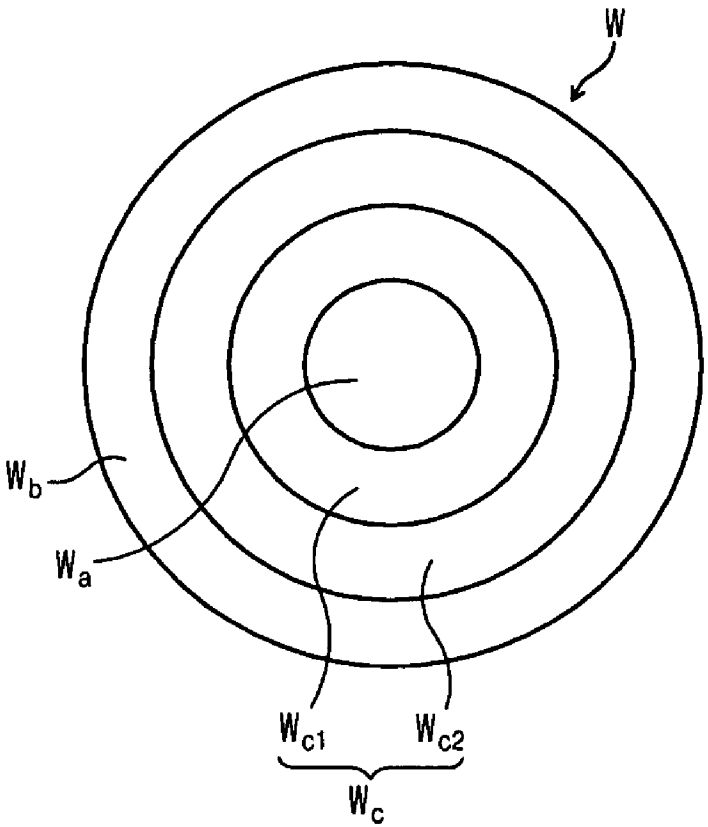
FIG. 16 is a conceptual plan view of the regions of pressure created on a wafer when barriers of the type shown in FIGS. 13 and 14 are used in a carrier head according to the present invention.

FIG. 16 illustrates the regions of pressure created on the wafer W, corresponding to the primary 520 and secondary pressure zones, when barriers of the type shown in FIGS. 13 and 14 are used. In the figure, $W_a$ designates a central circular region of pressure corresponding to primary pressure zone 520*a* (refer back to FIG. 3), $W_c$ designates one or more annular intermediate pressure regions corresponding to primary pressure zone(s) 520*c* ($W_{c1}$, $W_{c2}$ corresponding to 522*c*, 524*c*), and $W_b$ designates an outer annular region of pressure corresponding to the primary pressure zone 520*b*. The regions of pressure on the wafer, corresponding to the secondary pressure zones, are shown as being much narrower than those shown in FIG. 15 because pressure in each secondary pressure zone is concentrated along the single wall of the partition portion 440" of a barrier 400" instead of across a channel 480 or 480'. Accordingly, the embodiments of FIGS. 5 and 12 are more effective than the embodiment of FIG. 14 in evening out the distribution of forces over the back surface of a wafer.

According to the present invention as described above, a barrier that divides the pressure chamber of a carrier head into discrete primary pressure zones has a contact portion whose bottom surface abuts a membrane such that the barrier contacts the membrane but is not fixedly attached thereto. The contact portion comprises annular flanges that extend into the primary pressure zones, respectively, and the annular flanges each have a cross section that has curvature and tapers to a point in a direction away from the partition portion. Accordingly, the fluid introduced into the primary pressure zones not only acts on the membrane to exert pressure across a region of the wafer secured to the membrane, but also acts on the flanges to pin the flanges against the membrane and keep them there. Accordingly, a most highly effective seal is maintained between the barrier and the membrane, i.e., between the primary pressure zones. Therefore, the pressure in the primary pressure zones can be independently controlled so as to enhance the polishing of the wafer.

Also, a secondary pressure zone is created at each barrier so that pressure is exerted on the membrane at the boundary between adjacent ones of the primary pressure zones. The barrier may define an annular channel that makes up at least part of the secondary pressure zone. In this case, the pressure gradient across the primary pressure zones, including at the location of the boundary between the zones, can be made extremely smooth. Thus, the wafer may be polished to a correspondingly high degree of smoothness.

Finally, although the present invention has been described above in connection with the preferred embodiments thereof, the present invention is not so limited. Rather, various changes to and modifications of the preferred embodiments will become readily apparent to those of ordinary skill in the art. Accordingly, the present invention is not limited to the preferred embodiments described above. Rather, the true spirit and scope of the invention is defined by the accompanying claims.

What is claimed is:

1. A carrier head for chemical mechanical polishing equipment, comprising:

a support having a bottom surface;

an elastic membrane secured to said support and spaced from the bottom surface of said support so that a pressure chamber is defined between the membrane and the bottom surface of the support; and an annular barrier of elastic material extending from the bottom surface of said support, said barrier having an annular partition portion that extends through said pressure chamber and divides the pressure chamber into respective pressure zones on opposite sides of the annular partition, and an annular contact portion that extends from a lower end of said partition portion, said contact portion having a bottom surface that abuts said membrane such that the barrier contacts the membrane but is not fixedly attached thereto, and said contact portion comprising a pair of annular flanges extending laterally in opposite directions at the lower end of said partition portion, each of said flanges having a cross section that tapers to a point in the direction from which the flange extends from the partition portion, whereby fluid pressure in the pressure zones can deflect the flanges to maintain the entire bottom surface of the contact portion in contact with said membrane.

2. The carrier head of claim 1, wherein said bottom surface of the contact portion is concave such that the cross section of the contact portion is crescent-shaped when the barrier is in its relaxed state.

3. The carrier head of claim 1, wherein said bottom surface of the contact portion is flat when the barrier is in its relaxed state.

4. The carrier head of claim 1, wherein said bottom surface of the contact portion is convex when the barrier is in its relaxed state.

5. A chemical mechanical polishing apparatus comprising:

a rotary platen;

a polishing pad disposed on top of said platen and fixed to said platen so as to rotate therewith;

a slurry supply arm through which slurry is dispensed onto said polishing pad; and a carrier assembly disposed over said polishing pad, said carrier assembly comprising a carrier head that holds a substrate to be polished against the polishing pad, a drive shaft to which said carrier head is mounted, and a motor connected to said drive shaft, said carrier head comprising a support having a bottom surface, an elastic membrane secured to said support and spaced from the bottom surface of said support so that a pressure chamber is defined between the membrane and the bottom surface of the support, and an annular barrier of elastic material extending from the bottom surface of said support, said barrier having an annular partition portion that extends through said pressure chamber and divides the pressure chamber into respective pressure zones on opposite sides thereof, and an annular contact portion that extends from a lower end of said partition portion, said contact portion having a bottom surface that abuts said membrane such that the barrier contacts the membrane but is not fixedly attached thereto, and said contact portion comprising a pair of annular flanges extending laterally in opposite directions at the lower end of said partition portion, each of said flanges having a cross section that tapers to a point in the direction from which the flange extends from the partition portion, whereby fluid pressure in the pressure zones can deflect the flanges to maintain the entire bottom surface of the contact portion in contact with said membrane.

6. The chemical mechanical polishing apparatus of claim 5, wherein said bottom surface of the contact portion of said barrier is concave such that the cross section of the contact portion is crescent-shaped when the barrier is in its relaxed state.

7. The chemical mechanical polishing apparatus of claim 5, wherein said bottom surface of the contact portion of said barrier is flat when the barrier is in its relaxed state.

8. The chemical mechanical polishing apparatus of claim 5, wherein said bottom surface of the contact portion of said barrier is convex when the barrier is in its relaxed state.

9. A carrier head for chemical mechanical polishing equipment, comprising:

a support having a bottom surface;

an elastic membrane secured to said support and spaced from the bottom surface of said support so that a pressure chamber is defined between the membrane and the bottom surface of the support; and an annular barrier extending from the bottom surface of said support and configured to divide said pressure chamber into a first primary pressure zone, a secondary pressure zone and a second primary pressure zone, said barrier including an annular partition portion that extends through said pressure chamber, and an annular contact portion having a bottom surface that abuts said membrane such that said barrier contacts said membrane but is not fixedly attached thereto, said annular partition portion comprising first and second annular walls spaced from one another in a radial direction of the barrier, the secondary pressure zone being defined between said annular walls, the first primary pressure zone being defined to one side of the barrier adjacent said first annular wall, and the second primary pressure zone being defined to the other side of the barrier adjacent said second annular wall, and said annular contact portion comprising a central section that extends between and connects lower ends of the first and second walls across said secondary pressure zone, a first annular flange that extends from a lower end of the first annular wall into the first primary pressure zone, and a second annular flange that extends from a lower end of the second annular wall into the second primary pressure zone.

10. The carrier head of claim 9, wherein said bottom surface of the contact portion is concave when the barrier is in its relaxed state.

11. The carrier head of claim 5, wherein said bottom surface of the contact portion is flat when the barrier is in its relaxed state.

12. The carrier head of claim 9, wherein said bottom surface of the contact portion is convex when the barrier is in its relaxed state.

13. A chemical mechanical polishing apparatus comprising:

a rotary platen;

a polishing pad disposed on top of said platen and fixed to said platen so as to rotate therewith;

a slurry supply arm through which slurry is dispensed onto said polishing pad; and a carrier assembly disposed over said polishing pad, said carrier assembly comprising a carrier head that holds a substrate to be polished against the polishing pad, a drive shaft to which said carrier head is mounted, and a motor connected to said drive shaft, said carrier head comprising a support having a bottom surface, an elastic membrane secured to said support and spaced from the bottom surface of said support so tat a pressure chamber is defined between the membrane and the bottom surface of the support, and an annular barrier extending from the bottom surface of said support and configured to divide said pressure chamber into a first primary pressure zone, a secondary pressure zone and a second primary pressure zone, said barrier including an annular partition portion that extends through said pressure chamber, and an annular contact portion having a bottom surface that abuts said membrane such that said barrier contacts said membrane but is not fixedly attached thereto, said annular partition portion comprising first and second annular walls spaced from one another in a radial direction of the barrier, the secondary pressure zone being defined between said annular walls, the first primary pressure zone being defined to one side of the barrier adjacent said first annular wall, and the second primary pressure zone being defined to the other side of the barrier adjacent said second annular wall, and said annular contact portion comprising a central section that extends between and connects lower ends of the first and second walls across said secondary pressure zone, a first annular flange that extends from a lower end of the first annular wall into the first primary pressure zone, and a second annular flange that extends from a lower end of the second annular wall into the second primary pressure zone.

14. The chemical mechanical polishing apparatus of claim 13, wherein said bottom surface of the contact portion of said barrier is concave when the barrier is in its relaxed state.

15. The chemical mechanical polishing apparatus of claim 13, wherein said bottom surface of the contact portion of said barrier is flat when the barrier is in its relaxed state.

16. The chemical mechanical polishing apparatus of claim 13, wherein said bottom surface of the contact portion of said barrier is convex when the barrier is in its relaxed state.

17. A carrier head for chemical mechanical polishing equipment, comprising:

a support having a bottom surface;

an elastic membrane secured to said support and spaced from the bottom surface of said support so that a pressure chamber is defined between the membrane and the bottom surface of the support; and at least one annular barrier extending from the bottom surface of said support, each said barrier including an annular partition portion that extends through said pressure chamber so as to divide said pressure chamber into a plurality of annular primary pressure zones adjacent the opposite sides of the barrier, and an annular contact portion having a bottom surface that abuts said membrane such that each said barrier contacts said membrane but is not fixedly attached thereto, said annular partition portion comprising first and second annular walls spaced from one another in a radial direction of the barrier so as to define an annular channel constituting a secondary pressure zone therebetween, the annular channel defined by each said barrier being substantially narrower than the primary pressure zones adjacent the opposites sides of the barrier as measured in said radial direction, and said annular contact portion comprising a first annular flange that extends from a lower end of the first annular wall into one of said pressure zones, and a second annular flange that extends from a lower end of the second annular wall into another of said pressure zones;

a first fluid pressure supply line system comprising first fluid supply lines extending through said support and respectively communicating with said primary pressure zones; and a second fluid pressure supply line system, discrete from said first fluid pressure supply line system, and comprising at least one second fluid pressure supply line extending through said support and communicating with each said secondary pressure region.

18. The carrier head of claim 17, wherein the contact portion of each said barrier includes a central section tat extends between and connects lower ends of the first and second walls.

19. The carrier head of claim 17, wherein each said barrier comprises first and second annular discrete members spaced apart from one another, said first discrete member being constituted by a said first annular wall and a said first flange portion, and said second discrete member being constituted by a said second annular wall and a said second flange portion.

20. The carrier head of claim 17, wherein said bottom surface of the contact portion of each said barrier is concave when the barrier is in its relaxed state.

21. The carrier head of claim 17, wherein said bottom surface of the contact portion of each said barrier is flat when the barrier is in its relaxed state.

22. The carrier head of claim 17, wherein said bottom surface of the contact portion of each said barrier is convex when the barrier is in its relaxed state.

23. A chemical mechanical polishing apparatus comprising:

a rotary platen;

a polishing pad disposed on top of said platen and fixed to said platen so as to rotate therewith;

a slurry supply arm through which slurry is dispensed onto said polishing pad; and a carrier assembly disposed over said polishing pad, said carrier assembly comprising a cater head that holds a substrate to be polished against the polishing pad, a drive shaft to which said carrier head is mounted, and a motor connected to said drive shaft, said carrier head comprising a support having a bottom surface, an elastic membrane secured to said support and spaced from the bottom surface of said support so that a pressure chamber is defined between the membrane and the bottom surface of the support, and at least one annular barrier extending from the bottom surface of said support, each said barrier including an annular partition portion that extends through said pressure chamber so as to divide said pressure chamber into a plurality of annular primary pressure zones adjacent the opposite sides of the barrier, and an annular contact portion having a bottom surface that abuts said membrane such that each said barrier contacts said membrane but is not fixedly attached thereto, said annular partition portion comprising first and second annular walls spaced from one another in a radial direction of the barrier so as to define an annular channel constituting a secondary pressure zone therebetween, the annular channel defined by each said barrier being substantially narrower than the primary pressure zones adjacent the opposites sides of the barrier as measured in said radial direction, and said annular contact portion comprising a first annular flange that extends from a lower end of the first annular wall into one of said pressure zones, and a second annular flange that extends from a lower end of the second annular wall into another of said pressure zones;

a first fluid pressure supply line system comprising first fluid supply lines extending through said support and respectively communicating with said primary pressure zones; and a second fluid pressure supply line system, discrete from said first fluid pressure supply line system, and comprising at least one second fluid pressure supply line extending through said support and communicating with each said secondary pressure region.

24. The chemical mechanical polishing apparatus of claim 23, wherein the contact portion of each of the barriers includes a central section that extends between and connects lower ends of the first and second walls.

25. The chemical mechanical polishing apparatus of claim 23, wherein each of said barriers comprises first and second annular discrete members spaced apart from one another, said first discrete member being constituted by a said first annular wall and a said first flange portion, and said second discrete member being constituted by a said second annular wall and a said second flange portion.

26. The chemical mechanical polishing apparatus of claim 23, wherein said bottom surface of the contact portion of each of said barriers is concave when the barrier is in its relaxed state.

27. The chemical mechanical polishing apparatus of claim 23, wherein said bottom surface of the contact portion of each of said barriers is flat when the barrier is in its relaxed state.

* * * * *